US006821387B2

(12) United States Patent
Hu

(10) Patent No.: US 6,821,387 B2
(45) Date of Patent: Nov. 23, 2004

(54) USE OF FRACTIONATED FIBER FURNISHES IN THE MANUFACTURE OF TISSUE PRODUCTS, AND PRODUCTS PRODUCED THEREBY

(75) Inventor: Sheng-Hsin Hu, Appleton, WI (US)

(73) Assignee: Paper Technology Foundation, Inc., Kalamazoo, MI (US)

( * ) Notice: Subject to any disclaimer, the term of this patent is extended or adjusted under 35 U.S.C. 154(b) by 0 days.

(21) Appl. No.: 10/154,456

(22) Filed: May 23, 2002

(65) Prior Publication Data

US 2003/0127203 A1 Jul. 10, 2003

Related U.S. Application Data

(63) Continuation-in-part of application No. 10/025,833, filed on Dec. 19, 2001, now abandoned.

(51) Int. Cl.[7] ..... D21H 27/38
(52) U.S. Cl. ..... 162/129; 162/130; 162/109
(58) Field of Search ..... 162/112, 129, 162/130, 109

(56) References Cited

U.S. PATENT DOCUMENTS

| | | | |
|---|---|---|---|
| 3,085,927 | A | 4/1963 | Pesch |
| 3,598,696 | A | 8/1971 | Beck |
| 3,695,985 | A | 10/1972 | Brock et al. |
| 3,791,917 | A | 2/1974 | Bolton, III |
| 3,903,342 | A | 9/1975 | Roberts, Jr. |
| 3,953,638 | A | 4/1976 | Kemp |
| 3,997,647 | A | 12/1976 | Lassen |
| 4,075,382 | A | 2/1978 | Chapman et al. |
| 4,100,017 | A | 7/1978 | Flautt, Jr. |
| 4,113,911 | A | 9/1978 | LaFitte et al. |
| 4,145,464 | A | 3/1979 | McConnell et al. |
| 4,166,001 | A | 8/1979 | Dunning et al. |
| 4,196,245 | A | 4/1980 | Kitson et al. |
| 4,207,367 | A | 6/1980 | Baker, Jr. |
| 4,225,382 | A | 9/1980 | Kearney et al. |
| 4,239,792 | A | 12/1980 | Ludwa |
| 4,256,111 | A | 3/1981 | Lassen |
| 4,287,251 | A | 9/1981 | King et al. |
| 4,298,649 | A | 11/1981 | Meitner |
| 4,300,981 | A | 11/1981 | Carstens |
| 4,326,000 | A | 4/1982 | Roberts, Jr. |
| 4,377,615 | A | 3/1983 | Suzuki et al. |
| 4,436,780 | A | 3/1984 | Hotchkiss et al. |

(List continued on next page.)

FOREIGN PATENT DOCUMENTS

| | | |
|---|---|---|
| EP | 0568404 A1 | 11/1993 |
| EP | 0631014 A1 | 12/1994 |
| EP | 0824157 | 2/1998 |

(List continued on next page.)

OTHER PUBLICATIONS

Jorma Lumiainen, "Refining of chemical pulp", 9 pages.
U.S. patent application Ser. No. 10/154,413, Sheng–hsin Hu, filed May 23, 2002, Method and System for Manufacturing Tissue Products, and Products Produced Thereby.
U.S. patent application Ser. No. 10/154,490, Sheng–hsin Hu, filed May 23, 2002, Tissue Products and Methods for Manufacturing Tissue Products.

*Primary Examiner*—Peter Chin

(57) ABSTRACT

A tissue product having superior properties of softness, handfeel, and strength is disclosed. The product may show a reduced degree of sloughing, that is, a reduction in the amount of paper particles or flakes that are generated from the product upon the abrasion of the tissue product. In one embodiment, a two furnish process is employed. In some applications, both hardwood fibers and softwood fiber sources may be employed. At least one fiber furnish is fractionated or separated into short and long fiber fractions. The resulting product exhibits reasonably good strength and softness, with reduced sloughing.

21 Claims, 9 Drawing Sheets

U.S. PATENT DOCUMENTS 4,445,974 A 5/1984 Stenberg
4,469,735 A 9/1984 Trokhan
4,517,054 A 5/1985 Hujàla et al.
4,537,822 A 8/1985 Nanri et al.
4,548,856 A 10/1985 Khan et al.
4,610,915 A 9/1986 Crehshaw et al.
4,614,566 A 9/1986 Koponen et al.
4,618,524 A 10/1986 Groitzsch et al.
4,744,866 A 5/1988 Koponen et al.
4,781,793 A 11/1988 Halme
4,816,320 A 3/1989 Cyr
4,853,086 A 8/1989 Graef
4,885,202 A 12/1989 Lloyd et al.
4,888,092 A 12/1989 Prusas et al.
4,897,155 A 1/1990 Koteles
4,946,557 A 8/1990 Svending
4,964,954 A 10/1990 Johansson
4,964,955 A 10/1990 Lamar et al.
4,983,258 A 1/1991 Maxham
5,002,633 A 3/1991 Maxham
5,011,741 A 4/1991 Hoffman
5,048,589 A 9/1991 Cook et al.
5,087,324 A 2/1992 Awofeso et al.
5,127,994 A 7/1992 Johansson
5,129,988 A 7/1992 Farrington, Jr.
5,133,832 A 7/1992 Gilkey
5,137,599 A 8/1992 Maxham
5,192,388 A 3/1993 Schöllkopf et al.
5,228,954 A 7/1993 Vinson et al.
5,336,373 A 8/1994 Scattolino et al.
5,397,435 A 3/1995 Ostendorf et al.
5,399,412 A 3/1995 Sudall et al.
5,409,572 A 4/1995 Kershaw et al.
5,468,348 A 11/1995 Blackledge et al.
5,468,396 A 11/1995 Allen et al.
5,494,554 A 2/1996 Edwards et al.
5,501,768 A 3/1996 Hermans et al.
5,510,001 A 4/1996 Hermans et al.
5,527,432 A 6/1996 Leuthold et al.
5,529,665 A 6/1996 Kaun
5,543,202 A 8/1996 Clark et al.
5,582,681 A 12/1996 Back et al.
5,591,309 A 1/1997 Rugowski et al.
5,607,551 A 3/1997 Farrington, Jr. et al.
5,616,207 A 4/1997 Sudall et al.
5,620,565 A 4/1997 Lazorisak et al.
5,667,636 A 9/1997 Engel et al.
5,730,839 A 3/1998 Wendt et al.
5,785,813 A 7/1998 Smith et al.
5,830,317 A 11/1998 Vinson et al.
5,830,320 A 11/1998 Park et al.
5,834,095 A 11/1998 Dutkiewicz et al.
5,853,539 A 12/1998 Smith et al.
5,858,021 A 1/1999 Sun et al.
5,993,602 A 11/1999 Smith et al.
6,001,218 A 12/1999 Hsu et al.
6,017,417 A 1/2000 Wendt et al.
6,024,834 A 2/2000 Horton, Jr. et al.
6,027,610 A 2/2000 Back et al.
6,039,839 A 3/2000 Trokhan et al.
6,074,527 A 6/2000 Hsu et al.
6,080,266 A 6/2000 Horton, Jr. et al.
6,156,157 A 12/2000 Schroeder et al.
6,207,012 B1 3/2001 Oriaran et al.
6,248,210 B1 6/2001 Edwards et al.
6,296,736 B1 10/2001 Hsu et al.
6,372,085 B1 4/2002 Hsu et al.
6,387,210 B1 5/2002 Hsu et al.
6,391,154 B1 5/2002 Nygård et al.
6,413,363 B1 7/2002 Hsu et al.
6,511,579 B1 1/2003 Edwards et al.

FOREIGN PATENT DOCUMENTS

WO PCT/US95/08168 6/1995
WO WO 96/00811 1/1996
WO PCT/US96/16477 10/1996
WO WO 97/15711 5/1997
WO PCT/US97/21427 11/1997
WO PCT/US97/22238 11/1997
WO WO 98/23813 6/1998
WO WO 98/23814 6/1998
WO 2002/0162635 11/2002

USE OF FRACTIONATED FIBER FURNISHES IN THE MANUFACTURE OF TISSUE PRODUCTS, AND PRODUCTS PRODUCED THEREBY

RELATED APPLICATIONS

This application is a continuation-in-part of U.S. application Ser. No. 10/025,833, which was filed on Dec. 19, 2001, now abandoned.

BACKGROUND OF THE INVENTION

Strength and softness are important attributes in consumer tissue products such as bathroom tissue, towels, and napkins. Strength and softness are strongly influenced by the sheet structure of a tissue product. The type and arrangement of fibers employed in the manufacture of tissue products are important factors in determining the strength and softness of products made from such fibers.

Strength and softness usually are inversely related. That is, the stronger a given sheet, the less softness that sheet is likely to provide. Likewise, a softer sheet is usually not as strong. Thus, this inverse relationship between strength and softness results in a constant endeavor in the industry to produce a sheet having a strength that is at least as high as conventional prior art sheets, but with improved softness. Also, a sheet that is at least as soft as known sheets, but with improved strength, is desirable.

It is common in the manufacture of tissue products to provide two furnishes (or sources) of fiber. Sometimes, a two-furnish system is used in which the first furnish is comprised of hardwood eucalyptus wood fibers, and the second furnish is made of Northern softwood fibers. Eucalyptus hardwood fibers tend to be softer and more "fuzzy" to the touch, and therefore often these fiber types are provided on outer surfaces of a tissue product.

As a general rule fibers having better softness are provided in outer layers of tissue products—which routinely contact the skin of consumers. The inner layers of tissue products often may comprise fibers, which provide strength. Thus, in this way the desirable properties of tissue products can be maximized at a minimal cost in raw materials. Further, debonding agents have also traditionally be utilized to further soften the tissue product.

Unfortunately, however, sloughing sometimes is increased by the use of debonding agents. Sloughing may be described generally as the loss of paper particles from the surface of the paper due to surface abrasion. Many consumers react negatively to paper that exhibits a high degree of sloughing.

Thus, it would be desirable to provide a process and product that can provide a high level of softness, strength, and absorbent capacity for good handfeel, but with reduced sloughing.

SUMMARY OF THE INVENTION

In accordance with one embodiment of the present invention, a method of making a tissue product (single- or multi-ply) is disclosed. The method comprises (a) providing a first furnish of softwood fibers; (b) providing a second furnish of hardwood fibers; (c) fractionating the first furnish of softwood fibers into a long fiber fraction and a short fiber fraction; (d) diverting the short fiber fraction to the second furnish to form a third furnish; (e) forming a first layer using the long fiber fraction of the first furnish; (f) forming a second layer using the third furnish; and (g) incorporating the first layer and the second layer into a first ply.

For example, in some embodiments, the first layer can be placed adjacent to the second layer and crimped therewith to form the ply. If desired, the first layer and the second layer can also define outer surfaces of the first ply.

In addition, the method can also comprise combining the first ply with a second ply. In one embodiment, the second ply is comprised of at least two layers. For example, one layer of the second ply may be formed from the long fiber fraction of the first furnish and another layer may be formed from the third furnish. Optionally, the layer of the second ply formed of the long fiber fraction of the first furnish can be positioned adjacent to the first layer of the first ply.

The hardwood and/or softwood fibers may generally be used in the tissue product in any desired amount. For example, in some embodiments, the weight percentage of hardwood fibers in the tissue product is from about 50 and about 80 percent, and in some embodiments, from about 60 to about 70 percent. Likewise, the weight ratio of hardwood fibers to softwood fibers in the tissue product can, in one embodiment, be about 2:1.

Thus, it is possible to product a layered structure in which at least one layer employs hardwood fibers enhanced with the short fiber fraction of a softwood furnish, while at least one additional layer employs the long fiber fraction of the softwood furnish. A one ply, two-layered tissue may be constructed. Also, a two-ply, two-layered tissue or a three-ply, two-layered tissue may be constructed. Regardless of the construction utilized, the tissue of the present invention can have reduced levels of slough, with about the same or comparable levels of softness.

Other features and aspects of the present invention are discussed in greater detail below.

BRIEF DESCRIPTION OF THE DRAWINGS

A full and enabling disclosure of this invention, including the best mode shown to one of ordinary skill in the art, is set forth in this specification.

DETAILED DESCRIPTION OF THE INVENTION

Definitions

Figure 1:
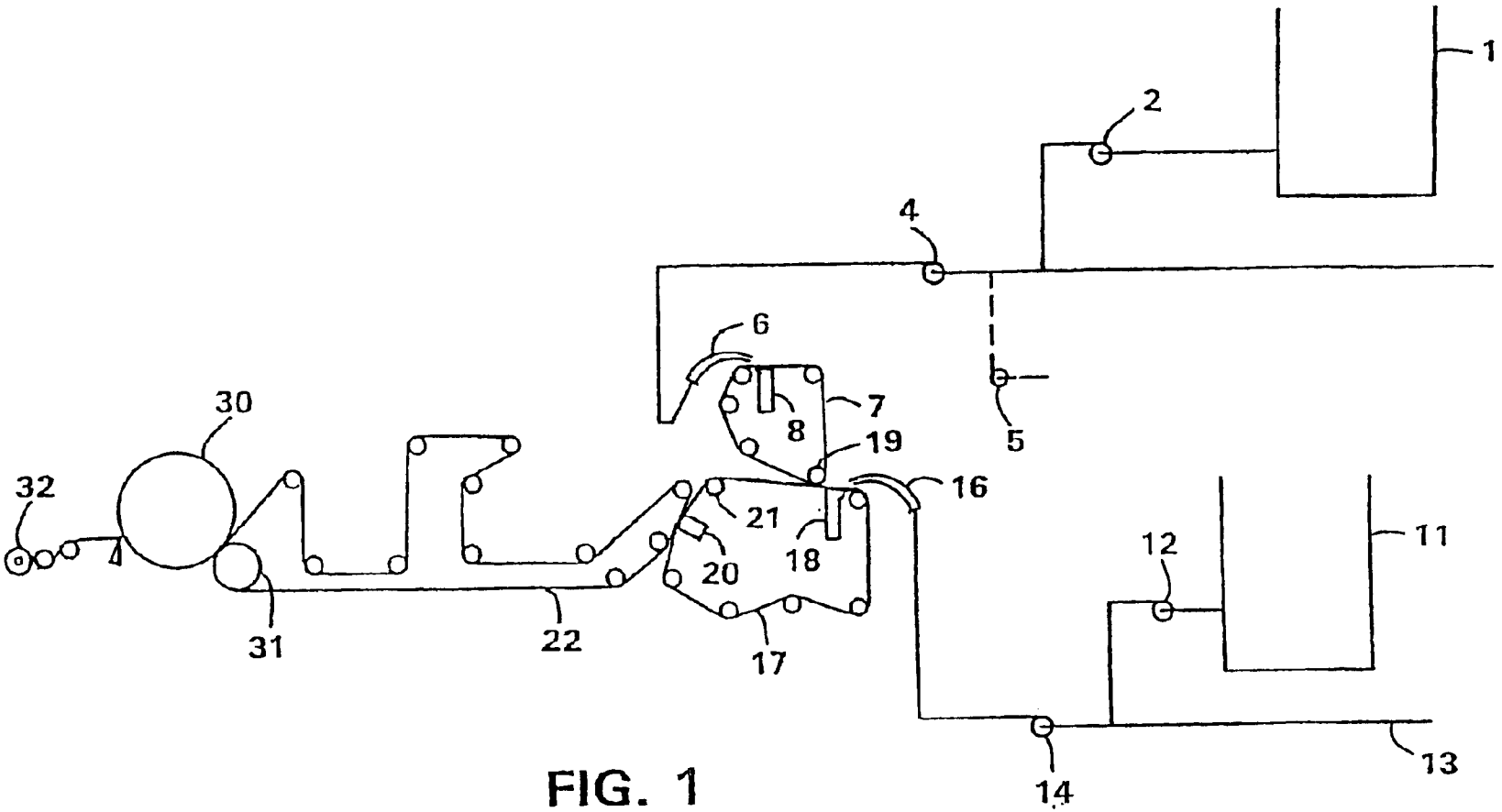
FIG. 1 is a schematic flow diagram of one embodiment of a papermaking process that can be used in the present invention.

As used herein, the term "fractionation" or "fraction" generally refers to separation of a mixture into separate components. More particularly, such terms refer to the separation of a cellulosic fiber mixture into separate cellulosic fiber fractions in which each fraction provides a different average length value for the fibers comprising the fraction.

As used herein, the term "layer" generally refers to a single thickness, course, stratum, or fold that may lay on its own, or that may lay over or under another. Further, the term "ply" can refer to a material produced from a headbox having one or more layers and a material produced by pressing together two or more wet webs that are each formed from a headbox having a single layer.

As used herein, a "tissue product" generally refers to various tissue products, such as facial tissue, bath tissue, paper towels, napkins, and the like. Normally, the basis weight of a tissue product of the present invention is less than about 80 grams per square meter (gsm), and in some embodiments less than about 60 gsm, and in other embodiments between about 10 to about 60 gsm. The basis weight for all examples provided below is 30 gsm.

As used herein, the term "fiber" or "fibrous" is meant to refer to a particulate material wherein the length to diameter ratio (aspect ratio) of such particulate material is greater than about 10. Conversely, a "nonfiber" or "nonfibrous" material is meant to refer to a particulate material wherein the length to diameter ratio of such particulate material is about 10 or less. It is generally desired that the cellulosic fibers used herein be wettable.

DETAILED DESCRIPTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Surprisingly, in the practice of this invention, it has been discovered that a tissue product that contains one layer formed from the long portion of fractionated softwood fibers and another layer formed from hardwood fibers and the short portion of fractionated softwood fibers can provide superior sloughing and softness characteristics.

A wide variety of cellulosic fibers may generally be employed in the process of the present invention. Illustrative cellulosic fibers that may be employed in the practice of the invention include, but are not limited to, wood and wood products, such as wood pulp fibers (e.g., softwood or hardwood pulp fibers); non-woody paper-making fibers from cotton, from straws and grasses, such as rice and esparto, from canes and reeds, such as bagasse, from bamboos, form stalks with bast fibers, such as jute, flax, kenaf, cannabis, linen and ramie, and from leaf fibers, such as abaca and sisal. It is also possible to use mixtures of one or more cellulosic fibers. It is generally desired that the cellulosic fibers used herein be wettable. Suitable cellulosic fibers include those that are naturally wettable. However, naturally non-wettable fibers can also be used.

Softwood sources include trees sources, such as pines, spruces, and firs and the like. Hardwood sources, such as oaks, eucalyptuses, poplars, beeches, and aspens, may be used, but this list is by no means exhaustive of all the hardwood sources that may be employed in the practice of the invention. Hardwood fiber sources generally contain fibers of a shorter length than softwood sources. Many times, sloughing occurs when shorter fibers flake or fall from the outer hardwood layers of multi-layered tissues.

Fibers from different sources of wood exhibit different properties. Hardwood fibers, for example, tend to show high degrees of "fuzziness" or softness when placed on the exterior surface of a tissue product, such as a bathroom tissue. In many embodiments of the invention, a first furnish comprising a strength layer is employed. This first furnish may be a softwood, for example. The average fiber length of a softwood fiber typically is about two to four times longer than a hardwood fiber. In the practice of the present invention, it is desired that the cellulosic fibers be used in a form wherein the cellulosic fibers have already been prepared into a pulp. As such, the cellulosic fibers will be presented substantially in the form of individual cellulosic fibers, although such individual cellulosic fibers may be in an aggregate form such as a pulp sheet. This is in contrast with untreated cellulosic forms such as wood chips or the like. Thus, the current process is generally a post-pulping, cellulosic fiber separation process as compared to other processes that may be used for high-yield pulp manufacturing processes.

The preparation of cellulosic fibers from most cellulosic sources results in a heterogeneous mixture of cellulosic fibers. The individual cellulosic fibers in the mixture exhibit a broad spectrum of values for a variety of properties such as length, coarseness, diameter, curl, color, chemical modification, cell wall thickness, fiber flexibility, and hemicellulose and/or lignin content. As such, seemingly similar mixtures of cellulosic fibers prepared from the same cellulosic source may exhibit different mixture properties, such as freeness, water retention, and fines content because of the difference in actual cellulosic fiber make-up of each mixture or slurry.

In general, the cellulosic fibers may be used in the process of the present invention in either a dry or a wet state. However, it may be desirable to prepare an aqueous mixture comprising the cellulosic fibers wherein the aqueous mixture is agitated, stirred, or blended to effectively disperse the cellulosic fibers throughout the water.

The cellulosic fibers are typically mixed with an aqueous solution wherein the aqueous solution beneficially comprises at least about 30 weight percent water, suitably about 50 weight percent water, more suitably about 75 weight percent water, and most suitably about 100 weight percent water. When another liquid is employed with the water, such other suitable liquids include methanol, ethanol, isopropanol, and acetone. However, the use or presence of such other non-aqueous liquids may impede the formation of an essentially homogeneous mixture such that the cellulosic fibers do not effectively disperse into the aqueous solution and effectively or uniformly mix with the water. Such a mixture should generally be prepared under conditions that are sufficient for the cellulosic fibers and water to be effectively mixed together. Generally, such conditions will include using a temperature that is between about 10° C. and about 100° C. In general, cellulosic fibers are prepared by pulping or other preparation processes in which the cellulosic fibers are present in an aqueous solution.

In general, cellulosic fibers are prepared by pulping or other preparation processes in which the cellulosic fibers are present in an aqueous solution. For use in certain fractionation processes of the present invention, therefore, it may be possible to use an aqueous solution directly from such preparation processes without having to separately recover the cellulosic fibers. Specific fractions of a cellulosic fiber mixture have been discovered to exhibit improved properties that make such fractionated cellulosic fibers suitable for use in liquid absorption or liquid handling applications.

In some embodiments, a "softener" or "debonder" may be added to one or more layers of a ply used in the tissue of the present invention. As used herein, "softener" or "debonder" is a chemical compound that serves to soften the final tissue product. These compounds may be selected from the group of compounds consisting of: quaternary ammonium compounds, quaternary protein compounds, phospholipids, silicone quaternaries, quaternized, hydrolyzed wheat protein/dimethicone phosphocopolyol copolymer, organoreactive polysiloxanes, and silicone glycols. Other debonding agents also could be used.

For example, compounds and procedures similar to that disclosed in U.S. Pat. No. 6,156,157 could be employed. A quaternary ammonium compound softener/debonder (methyl-1-oleyl amidoethyl-2-oleyl imidazolinium methyl sulfate identified as Varisoft 3690 available from Witco Corporation could be employed, for example. Furthermore, as set forth in one or more examples below, an imidazoline-based debonding agent such as DC-83 manufactured by McIntyre Corporation of University Park, Ill., can be employed. In some applications, this debonding agent is added to the hardwood layers in an amount equivalent to about 6 lbs/Ton (i.e., to the two eucalyptus stock chests).

In the practice of the present invention, a fractionation device is used to separate a cellulosic fiber mixture into distinct components. Fractionation devices that are suitable for use in the present invention include, but are not limited to, equipment used to separate contaminants and/or inks from cellulosic fibers such as low-consistency washers, intermediate-consistency washers, high-consistency washers, flotation cells, flotation machines, centrifugal cleaners, pressure screens, and gravity screens. Although fractionation processes are generally accomplished under conditions such that the cellulosic fibers being fractionated are not damaged, the conditions under which a cellulosic fiber mixture is fractionated are not critical and may include a wide range of temperatures, pressures, consistencies, humidities and other conditions.

Papermaking Processes

A tissue product made in accordance with the present invention can generally be formed according to a variety of papermaking processes known in the art. In fact, any process capable of making a tissue web can be utilized in the present invention. For example, a papermaking process of the present invention can utilize wet-pressing, creping, through-air-drying, creped through-air-drying, uncreped through-air-drying, single recreping, double recreping, calendering, embossing, air laying, as well as other steps in processing the tissue web. For instance, some suitable papermaking processes are described in U.S. Pat. No. 5,129,988 to Farrington, Jr.; U.S. Pat. No. 5,494,554 to Edwards, et al.; and U.S. Pat. No. 5,529,665 to Kaun, which are incorporated herein in their entirety by reference thereto for all purposes.

In this regard, various embodiments of a method for forming a tissue web will now be described in more detail. Referring to FIG. 1, a method of making a wet-pressed tissue in accordance with one embodiment of the present invention is shown, commonly referred to as couch forming, wherein two wet web layers are independently formed and thereafter combined into a unitary web. To form the first web layer, a specified fiber (either hardwood or softwood) is prepared in a manner well known in the papermaking arts and delivered to the first stock chest 1, in which the fiber is kept in an aqueous suspension. A stock pump 2 supplies the required amount of suspension to the suction side of the fan pump 4. If desired, a metering pump 5 can supply an additive (e.g., latex, reactive composition, etc.) into the fiber suspension. Additional dilution water 3 also is mixed with the fiber suspension.

The entire mixture of fibers is then pressurized and delivered to the headbox 6. The aqueous suspension leaves the headbox 6 and is deposited on an endless papermaking fabric 7 over the suction box 8. The suction box 8 is under vacuum that draws water out of the suspension, thus forming the first layer. In this example, the stock issuing from the headbox 6 would be referred to as the "air side" layer, that layer eventually being positioned away from the dryer surface during drying.

The fabric 7 can be any forming fabric, such as fabrics having a fiber support index of about 150 or greater. Some suitable forming fabrics include, but are not limited to, single layer fabrics, such as the Appleton Wire 94M available from Albany International Corporation, Appleton Wire Division, Menasha, Wis.; double layer fabrics, such as the Asten 866 available from Asten Group, Appleton, Wis.; and triple layer fabrics, such as the Lindsay 3080, available from Lindsay Wire, Florence, Miss.

The consistency of the aqueous suspension of papermaking fibers leaving the headbox can be from about 0.05 to about 2%, and in one embodiment, about 0.2%. The first headbox 6 can be a layered headbox with two or more layering chambers which delivers a stratified first wet web layer, or it can be a monolayered headbox which delivers a blended or homogeneous first wet web layer.

To form the second web layer, a specified fiber (either hardwood or softwood) is prepared in a manner well known in the papermaking arts and delivered to the second stock chest 11, in which the fiber is kept in an aqueous suspension. A stock pump 12 supplies the required amount of suspension to the suction side of the fan pump 14. A metering pump 5 can supply additives (e.g., latex, reactive composition, etc.) into the fiber suspension as described above. Additional dilution water 13 is also mixed with the fiber suspension. The entire mixture is then pressurized and delivered to the headbox 16. The aqueous suspension leaves the headbox 16 and is deposited onto an endless papermaking fabric 17 over the suction box 18. The suction box is under vacuum that draws water out of the suspension, thus forming the second wet web. In this example, the stock issuing from the headbox 16 is referred to as the "dryer side" layer as that layer will be in eventual contact with the dryer surface. Suitable forming fabrics for the forming fabric 17 of the second headbox include those forming fabrics previously mentioned with respect to the first headbox forming fabric.

After initial formation of the first and second wet web layers, the two web layers are brought together in contacting relationship (couched) while at a consistency of from about 10 to about 30%. Whatever consistency is selected, it is typically desired that the consistencies of the two wet webs be substantially the same. Couching is achieved by bringing the first wet web layer into contact with the second wet web layer at roll 19.

After the consolidated web has been transferred to the felt 22 at vacuum box 20, dewatering, drying and creping of the consolidated web is achieved in the conventional manner. More specifically, the couched web is further dewatered and transferred to a dryer 30 (e.g., Yankee dryer) using a pressure roll 31, which serves to express water from the web, which is absorbed by the felt, and causes the web to adhere to the surface of the dryer. The web is then dried, optionally creped and wound into a roll 32 for subsequent converting into the final creped product.

Figure 2:
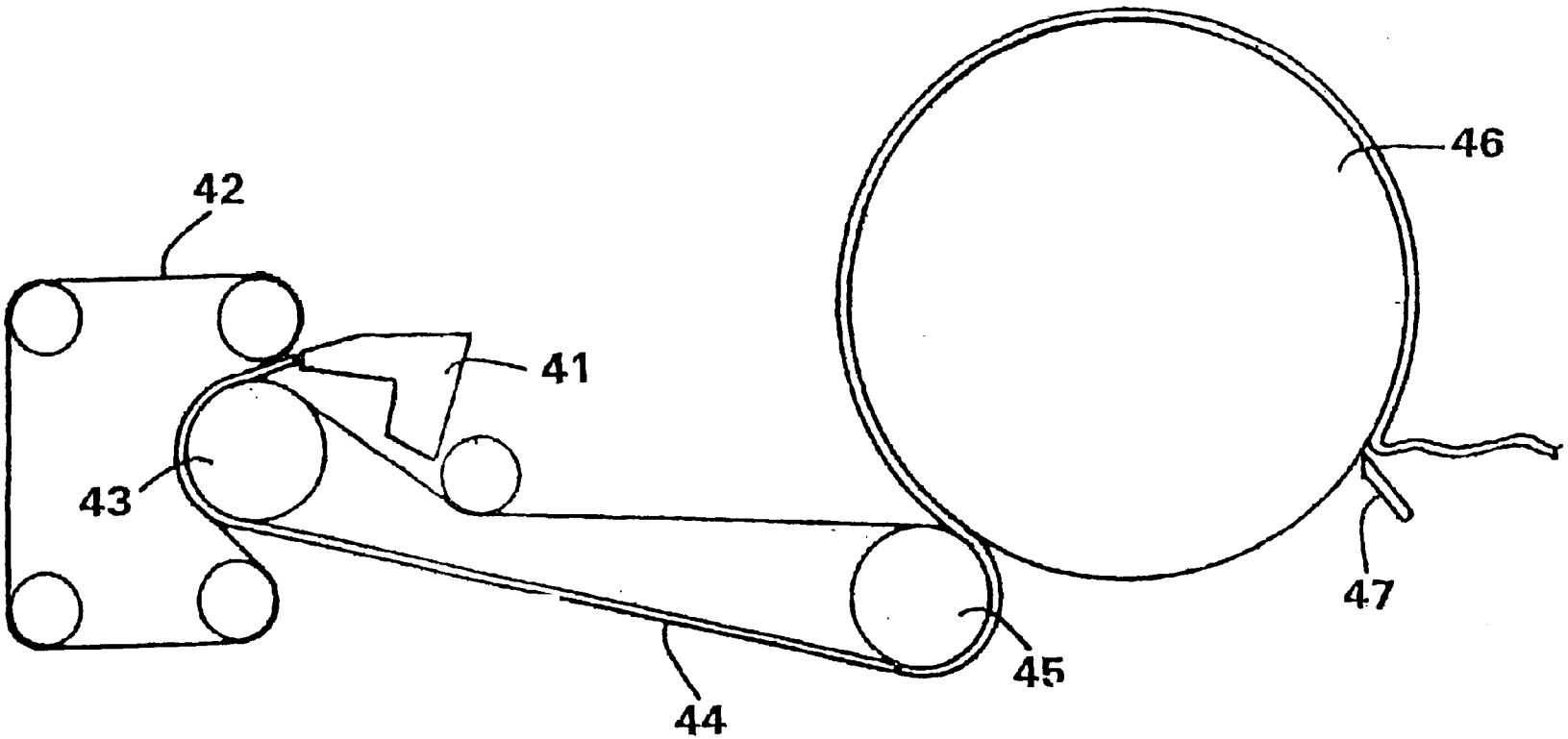
FIG. 2 is a schematic flow diagram of another embodiment of a papermaking process that can be used in the present invention.

FIG. 2 is a schematic flow diagram of another embodiment of a papermaking process than can be used in the present invention. For instance, a layered headbox 41, a forming fabric 42, a forming roll 43, a papermaking felt 44, a press roll 45, a Yankee dryer 46, and a creping blade 47 are shown. Also shown, but not numbered, are various idler or tension rolls used for defining the fabric runs in the schematic diagram, which may differ in practice. In operation, a layered headbox 41 continuously deposits a layered stock jet between the forming fabric 42 and the felt 44, which is partially wrapped around the forming roll 43. Water is removed from the aqueous stock suspension through the forming fabric 42 by centrifugal force as the newly formed web traverses the arc of the forming roll. As the forming fabric 42 and felt 44 separate, the wet web stays with the felt 44 and is transported to the Yankee dryer 46.

At the Yankee dryer 46, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer 46 is immediately following the creping doctor blade 47, permitting sufficient time for the spreading and drying of the film of fresh adhesive.

In some instances, reactive compositions may be applied to the web as it is being dried, such as through the use of the spray boom. For example, the spray boom can apply the additives to the surface of the drum 46 separately and/or in combination with the creping adhesives such that such additives are applied to an outer layer of the web as it passes over the drum 46. In some embodiments, the point of application on the surface of the dryer 46 is the point immediately following the creping blade 47, thereby permitting sufficient time for the spreading and drying of the film of fresh adhesive before contacting the web in the press roll nip. Methods and techniques for applying an additive to a dryer drum are described in more detail in U.S. Pat. No. 5,853,539 to Smith, et al. and U.S. Pat. No. 5,993,602 to Smith, et al.,
which are incorporated herein in their entirety by reference thereto for all purposes.

The wet web is applied to the surface of the dryer 46 by a press roll 45 with an application force of, in one embodiment, about 200 pounds per square inch (psi). Following the pressing or dewatering step, the consistency of the web is typically at or above about 30%. Sufficient Yankee dryer steam power and hood drying capability are applied to this web to reach a final consistency of about 95% or greater, and particularly 97% or greater. The sheet or web temperature immediately preceding the creping blade 47, as measured, for example, by an infrared temperature sensor, is typically about 235° F.

The web can also be dried using non-compressive drying techniques, such as through-air drying. A through-air dryer accomplishes the removal of moisture from the web by passing air through the web without applying any mechanical pressure. Through-air drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes.

Figure 3:
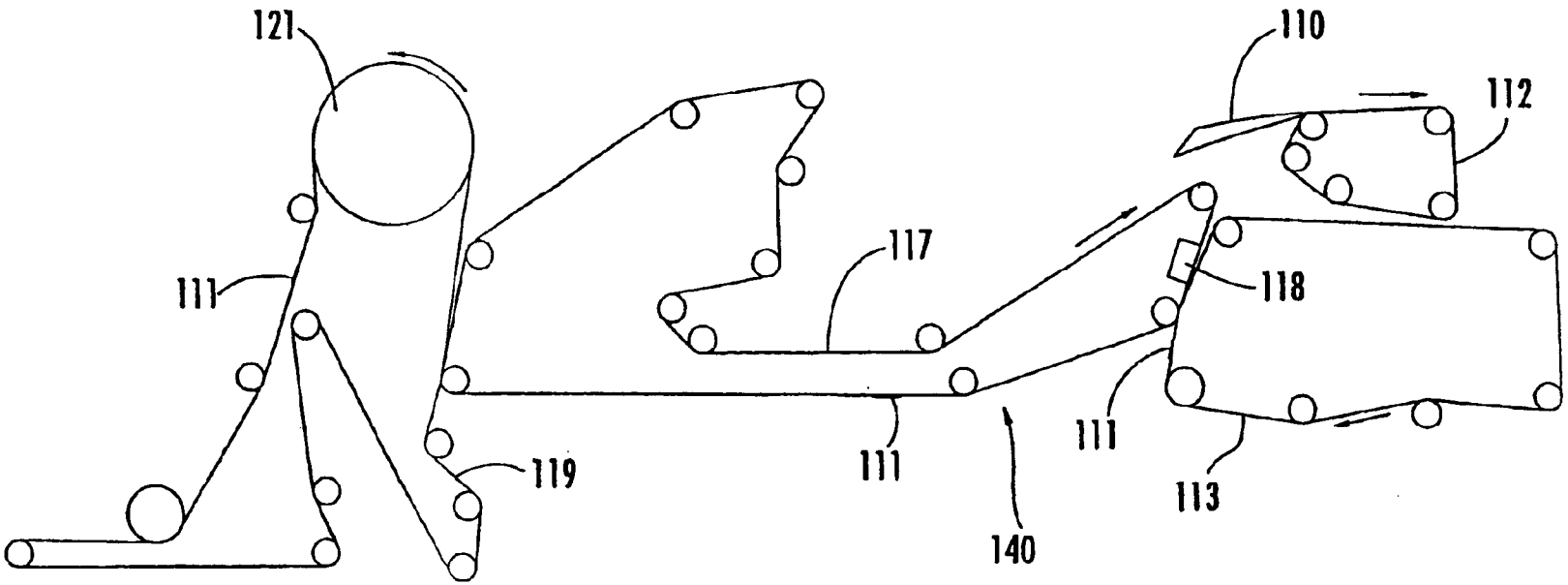
FIG. 3 is a schematic flow diagram of still another embodiment of a papermaking process that can be used in the present invention.

For example, referring to FIG. 3, one embodiment of a papermaking machine that can be used in forming an uncreped through-dried tissue product is illustrated. For simplicity, the various tensioning rolls schematically used to define the several fabric runs are shown but not numbered. As shown, a papermaking headbox 110 can be used to inject or deposit a stream of an aqueous suspension of papermaking fibers onto an upper forming fabric 112. The aqueous suspension of fibers is then transferred to a lower forming fabric 113, which serves to support and carry the newly-formed wet web 111 downstream in the process. If desired, dewatering of the wet web 111 can be carried out, such as by vacuum suction, while the wet web 111 is supported by the forming fabric 113.

The wet web 111 is then transferred from the forming fabric 113 to a transfer fabric 117 while at a solids consistency of between about 10% to about 35%, and particularly, between about 20% to about 30%. As used herein, a "transfer fabric" is a fabric that is positioned between the forming section and the drying section of the web manufacturing process. In this embodiment, the transfer fabric 117 is a patterned fabric having protrusions or impression knuckles, such as described in U.S. Pat. No. 6,017,417 to Wendt et al. Typically, the transfer fabric 117 travels at a slower speed than the forming fabric 113 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes.

Transfer to the fabric 117 may be carried out with the assistance of positive and/or negative pressure. For example, in one embodiment, a vacuum shoe 118 can apply negative pressure such that the forming fabric 113 and the transfer fabric 117 simultaneously converge and diverge at the leading edge of the vacuum slot. Typically, the vacuum shoe 118 supplies pressure at levels between about 10 to about 25 inches of mercury. As stated above, the vacuum transfer shoe 118 (negative pressure) can be supplemented or replaced by the use of positive pressure from the opposite side of the web to blow the web onto the next fabric. In some embodiments, other vacuum shoes can also be used to assist in drawing the fibrous web 111 onto the surface of the transfer fabric 117.

From the transfer fabric 117, the fibrous web 111 is then transferred to the through-drying fabric 119. When the wet web 111 is transferred to the fabric 119. While supported by the through-drying fabric 119, the web 111 is then dried by a through-dryer 121 to a solids consistency of about 95% or greater. The through-dryer 121 accomplishes the removal of moisture from the web 111 by passing air therethrough without applying any mechanical pressure. Through-drying can also increase the bulk and softness of the web 111. In one embodiment, for example, the through-dryer 121 can contain a rotatable, perforated cylinder and a hood for receiving hot air blown through perforations of the cylinder as the through-drying fabric 119 carries the web 111 over the upper portion of the cylinder. The heated air is forced through the perforations in the cylinder of the through-dryer 121 and removes the remaining water from the web 111. The temperature of the air forced through the web 111 by the through-dryer 121 can vary, but is typically from about 250° F. to about 500° F. It should also be understood that other non-compressive drying methods, such as microwave or infrared heating, can be used.

Figure 4A:
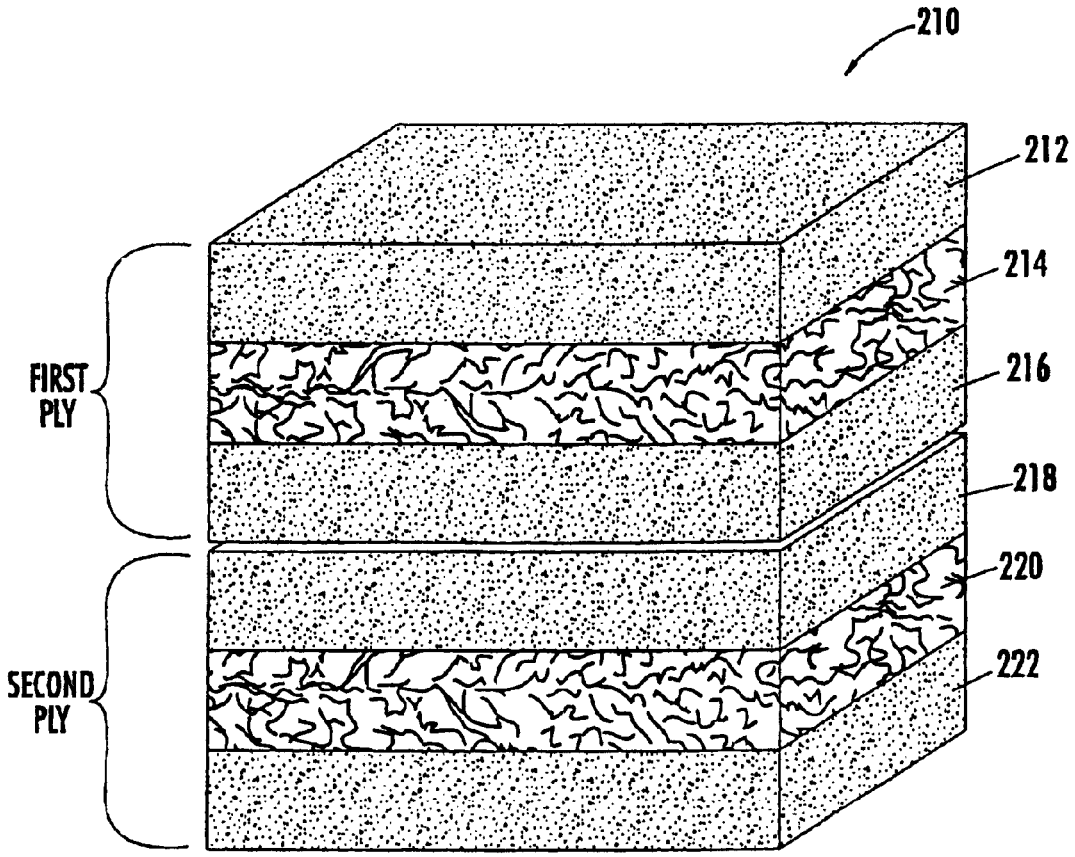
FIG. 4A is a schematic view showing a process for making a two-ply, two-layered, creped tissue product in accordance with one embodiment of the present invention.

FIG. 4A shows a process that utilizes creping in the manufacture of a two-ply, two-layered tissue product. In the FIG. 4A, a first furnish (which produces the strength layer) is separated into long and short fiber fractions. The short fiber fraction is supplied to a second furnish. The second furnish may contain hardwood fibers. Once the second furnish receives the short fiber fraction from the first furnish, it becomes a third furnish.

The third furnish becomes a first exterior layer, which faces the dryer, and a second exterior layer, which faces the dryer on the opposite side. The long fiber fraction becomes a first interior layer and a second interior layer. The first interior layer and the first exterior layer are pressed together while wet to form a first ply as shown in FIG. 4A. This two-layered ply could also be made from two-layered or a multi-layered headbox. Separately, a second exterior layer and a second interior layer are pressed together while wet to form a second ply. Then, the first ply and the second ply are crimped together along the edges in a later converting operation to form a two-ply, two-layered tissue product to form a four-layer ply.

The third furnish supplies the fiber source for producing the "soft" exterior layers, as shown in FIG. 4A, which are dried on the dryer side, against the Yankee dryer. At the converting operation, the first ply and second ply are crimped together along edges in a later converting operation to form a two-ply, two-layered tissue product.

Figure 4B:
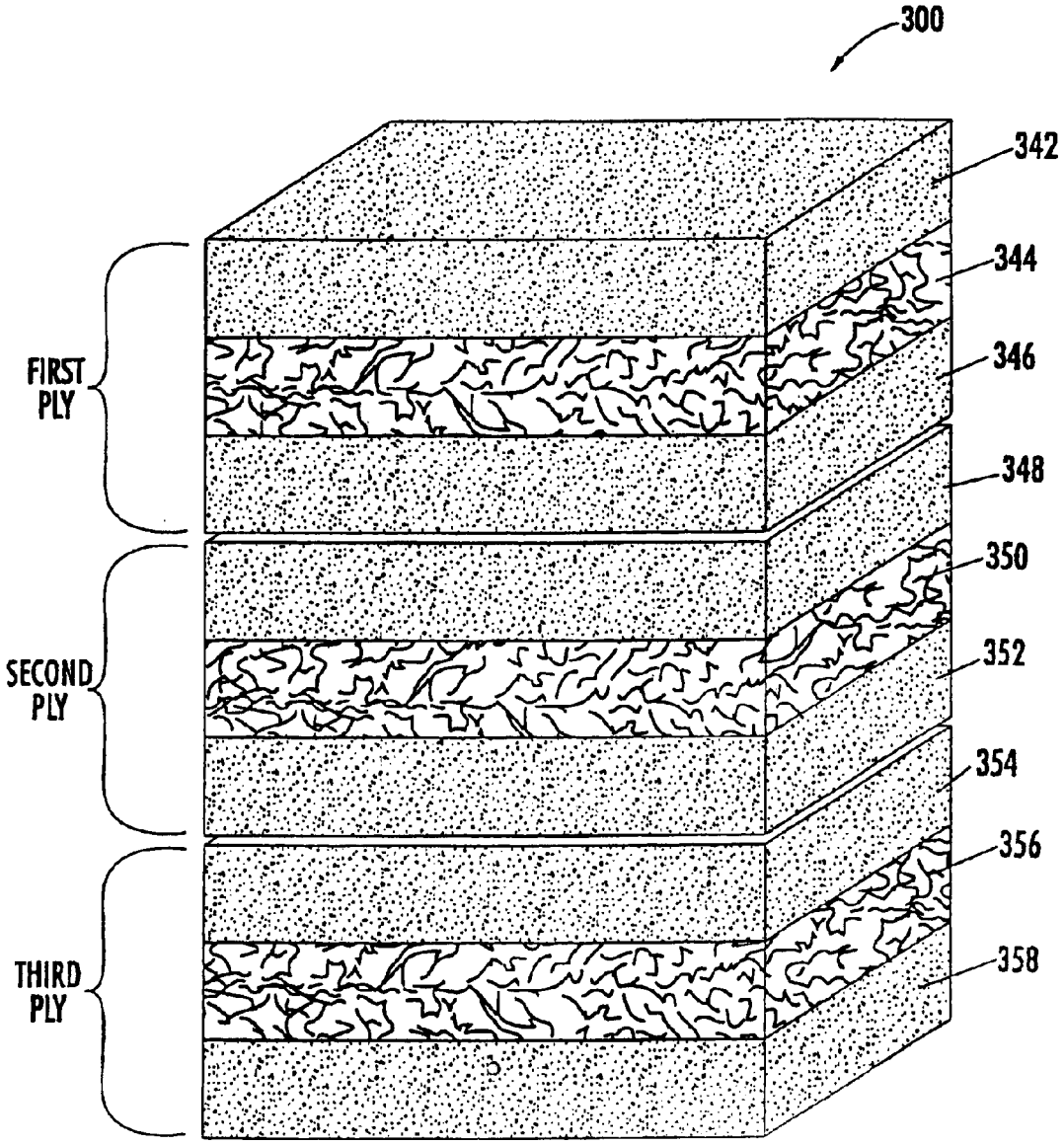
FIG. 4B is a schematic view showing a process for making a one ply, three-layered, creped tissue product in accordance with one embodiment of the present invention.

FIG. 4B shows a similar creped process for producing a three-layered product. It would be possible to produce products having four or more than four layers in a variety of combinations, but these examples are shown for illustrative purposes. The invention is not limited to any particular layering arrangement.

Figure 4C:
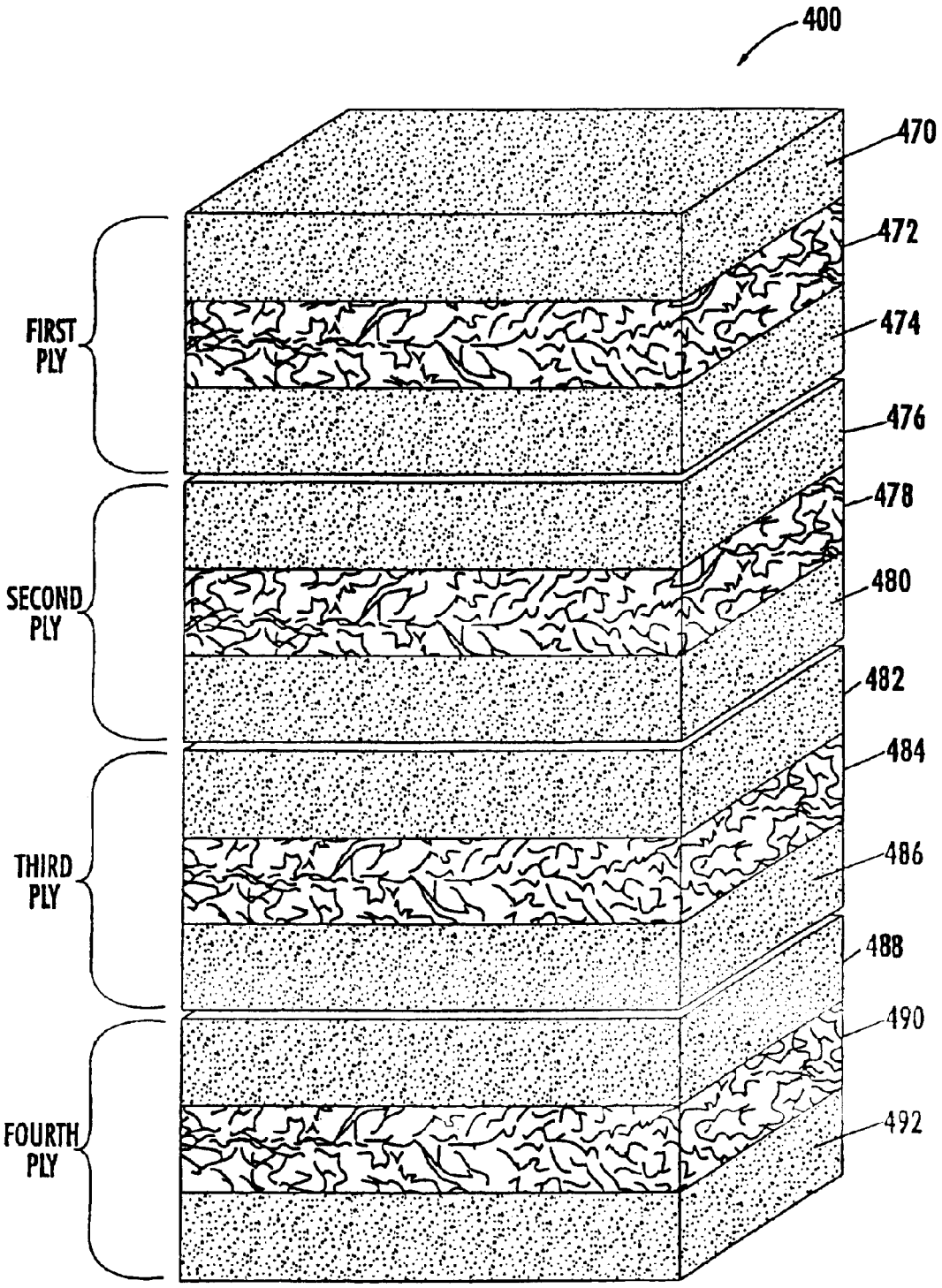
FIG. 4C is a schematic view showing a process for making a three-layered, uncreped, through-air dried tissue product in accordance with one embodiment of the present invention.

FIG. 4C shows an UCTAD process for producing a three-layered product. The process employs a fractionation of the first furnish, and the short fiber fraction is applied to the second furnish for use on the exterior layers of the product. The long fiber fraction of the first furnish is applied on the first interior layer, as shown in FIG. 4C.

Figure 4D:
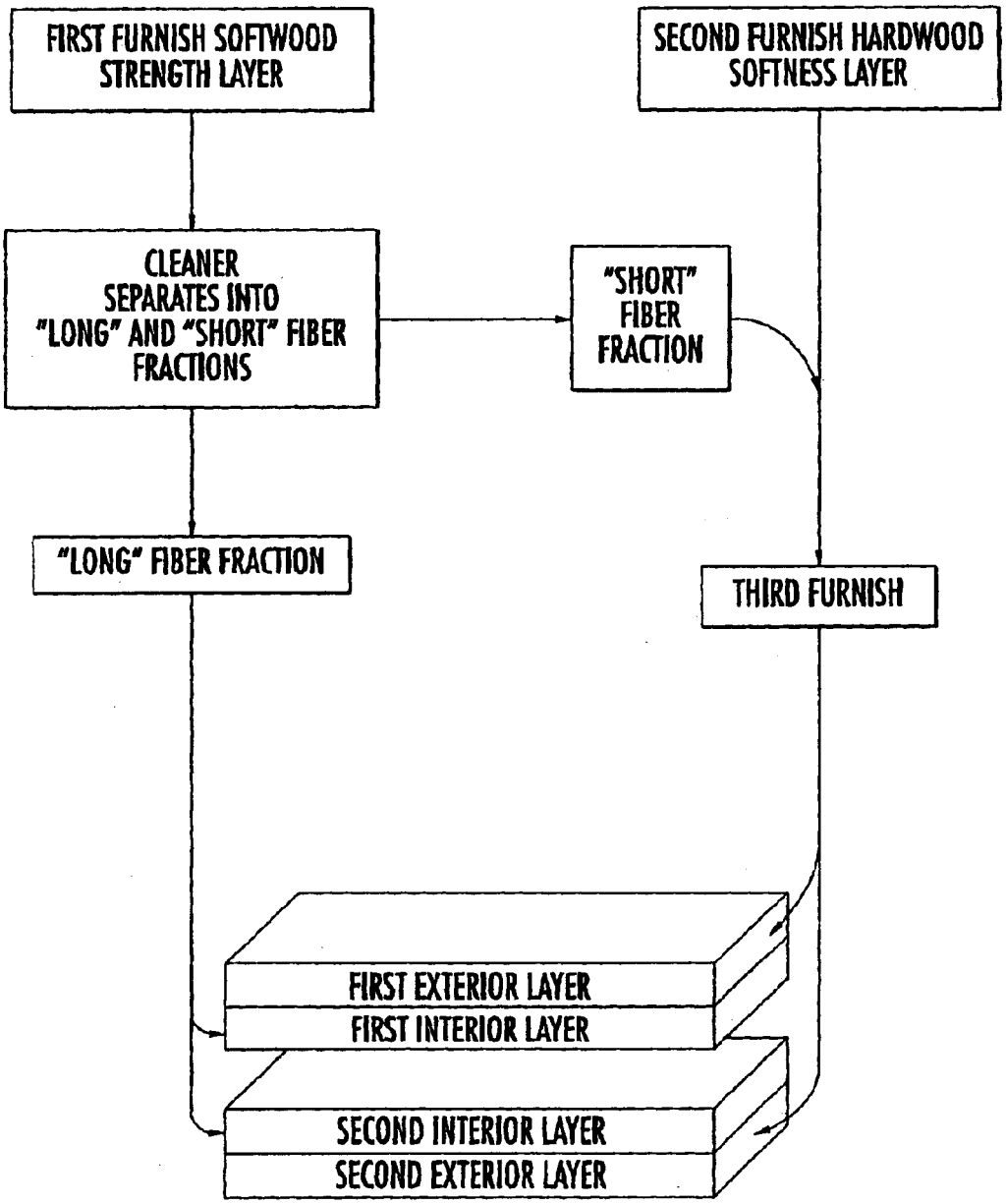
FIG. 4D is a schematic view showing a process for making a two-ply, two-layered, uncreped, through-air dried tissue product in accordance with one embodiment of the present invention.

FIG. 4D shows a two-layered, two-ply, uncreped, through-dried tissue product. In this embodiment, the product is made as shown in FIG. 4A except that no creping occurs in the tissue making. In this embodiment, the four-layer headbox may be employed in the manufacture of the four-layered product.

Figure 4E:
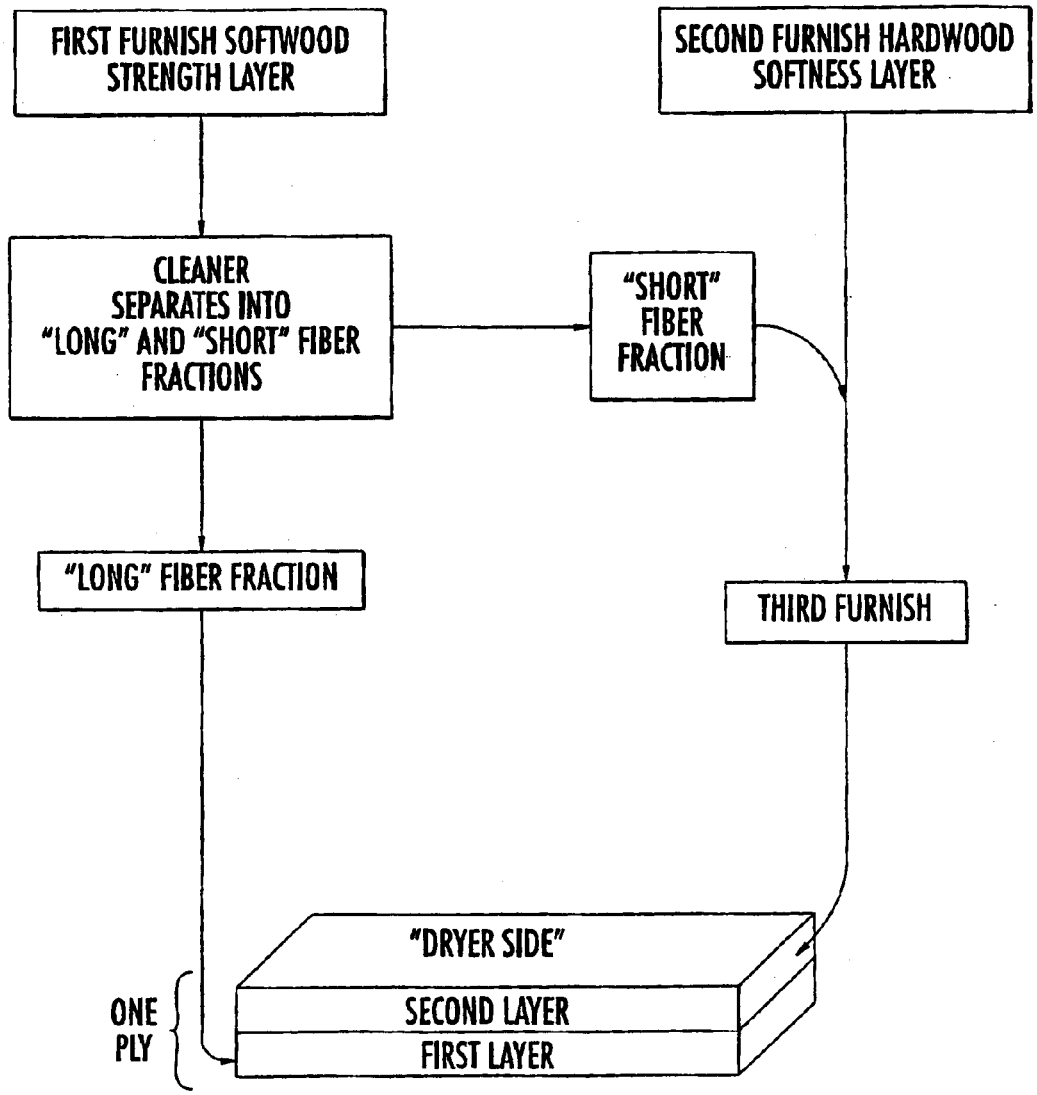
FIG. 4E is a schematic view showing a process for making a one-ply, two-layered tissue product in accordance with one embodiment of the present invention.

FIG. 4E shows a two-layered, uncreped, through-dried tissue product having one ply. In the product of this illustration, a method of making a tissue product having at least one ply is disclosed. In the method, a first furnish of softwood fibers and a second furnish of hardwood fibers are provided. The first furnish of softwood fibers is fractionated into a long fiber fraction and a short fiber fraction. Then, the short fiber fraction is diverted to the second furnish to form a third furnish, which ultimately becomes a second layer. The long fiber fraction becomes the first layer. Then, the first and second layers are pressed when both layers are wet to form a two-layer, one-ply tissue. The two-layered sheet could be also made from a two-layered headbox. In other embodiments, this ply can be replicated to make two-ply, three-ply, four-ply, etc., tissue products by crimping them together along the edges, and with the layer containing hardwood/short fraction furnish of the two most outside plys towards the outside to contact a user's skin during use.

In some embodiments, the first furnish is derived from a softwood. Likewise, in other embodiments, a second furnish derived from a hardwood is used to provide a softness layer for exposure to the outside of the tissue product, such as a facial or bathroom tissue. A first combined layer and a second combined layer may be joined to form a paper ply. The resulting tissue product may be formed from one ply, or multiple plies, such as two, three, or more plies.

Stiffness

Tensile strength was reported as "GMT" (grams per 3 inches of a sample), which is the geometric mean tensile strength and is calculated as the square root of the product of MD tensile strength and CD tensile strength. MD and CD tensile strengths were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4-inch gauge length for facial tissue and 2-inch gauge length for bath tissue. The crosshead speed during the test was 10-in./minute. The tester was connected with a computer loaded with data acquisition system; e.g., MTS TestWork for windows software. Readings were taken directly from a computer screen readout at the point of rupture to obtain the tensile strength of an individual sample.

Slough Measurement Methods and Apparatus

To determine the abrasion resistance or tendency of fibers to be rubbed from the web when handled samples were measured by abrading the tissue specimens by way of the following method. This test measures the resistance of tissue material to abrasive action when the material is subjected to a horizontally reciprocating surface abrader. All samples were conditioned at about 23° C. and about 50% relative humidity for a minimum of 4 hours.

Figure 5:
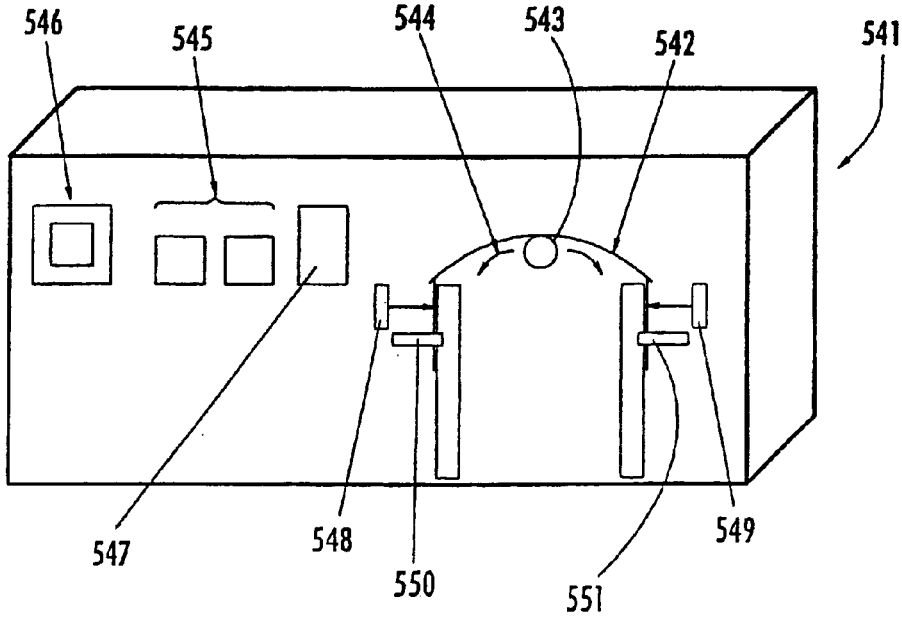
FIG. 5 is a perspective view of an apparatus designed to mechanically abrade paper samples in the measurement of slough.

FIG. 5 shows a diagram of the test equipment that may be employed to abrade a sheet. In FIG. 5, a machine 241 having a mandrel 243 receives a tissue sample 242. A sliding magnetic clamp 248 with guide pins (not shown) is positioned opposite a stationary magnetic clamp 249, also having guide pins (not shown). A cycle speed control 247 is provided, with start/stop controls 245 located on the upper panel, near the upper left portion of FIG. 6. A counter 246 is shown on the left side of machine 241, which displays counts or cycles.

In FIG. 5, the mandrel 243 used for abrasion consists of a stainless steel rod, 0.5" in diameter with the abrasive portion consisting of a 0.005" deep diamond pattern extending 4.25" in length around the entire circumference of the rod. The mandrel 243 is mounted perpendicular to the face of the machine 241 such that the abrasive portion of the mandrel 243 extends out from the front face of the machine 241. On each side of the mandrel 243 are located guide pins (not shown) for interaction with sliding magnetic clamp 248 and stationary magnetic clamp 249. These clamps 248–249 are spaced about 4" apart and centered about the mandrel 243. The clamps 248–249 are configured to slide freely in the vertical direction.

Using a die press with a die cutter, specimens are cut into 3" wide×8" long strips with two holes at each end of the sample. For tissue samples, the Machine Direction (MD) corresponds to the longer dimension. Each test strip is weighed to the nearest 0.1 mg. Each end of the sample 242 is applied upon the guide pins (not shown) and clamps 248–249 to hold the sample 242 in place. A movable jaw (not shown) is then allowed to fall providing constant tension across the mandrel 243.

The mandrel 243 is then moved back and forth at an approximate 15 degree angle from the centered vertical centerline in a reciprocal horizontal motion against the test strip for 20 cycles (each cycle is a back and forth stroke), at a speed of about 80 cycles per minute, removing loose fibers from the web surface. Additionally the spindle rotates counter clockwise (when looking at the front of the instrument) at an approximate speed of 5 revolutions per minute (rpm). The clamps 248–249 are then removed from the sample 242 and the sample 242 is removed by blowing compressed air (approximately 5–10 psi) on the sample 242.

The sample 242 is then weighed to the nearest 0.1 mg and the weight loss calculated. Ten test samples per tissue sample may be tested and the average weight loss value in milligrams is recorded. The result for each example was compared with a control sample containing no hairspray. Results are shown in FIG. 5, for control samples and for samples that have been fractionated according to the teachings of this invention.

EXAMPLE A

Fractionation of Softwood Fiber

A northern softwood kraft pulp (available from Kimberly-Clark Corporation; Northern Softwood fiber (LL-19 designation)) was used as a cellulose fiber sample. This cellulosic fiber sample was fractionated using a cleaner available from Beloit Inc. under the designation 76 mm Posiflow UltraLong with 13 mm conic tip, 25 mm feed insert and 22 mm vortex finder. The operation conditions were as follows: feed consistency: 0.73%; inlet flow rate of about 66.5 GPM, inlet pressure of about 40 PSI. Adjust the accepts portion pressure at 10 PSI and results in 70% of inlet fiber (weight basis) come out from cleaner bottom (rejects) and 30% emerge from accepts. The rejects portion constitutes the long fiber fraction and the accepts portion constitutes the short fiber fraction. The feed accepts and rejects fiber batches are formed into 60-gram handsheets and test their properties. The results are as follows:

TABLE 1

| | Feed | Accepts | Rejects |
|---|---|---|---|
| Weight % | 100 | 30 | 70 |
| Freeness (mls) | 685 | 635 | 705 |
| Tensile Index, Nm/g | 27 | 37.9 | 24 |
| Population Avg. Length, mm | 1.03 | 0.89 | 1.13 |

The term "population average fiber length" refers to a population weighted average length of pulp fibers determined utilizing an optical fiber analyzer such as Kajaani fiber analyzer model No. FS-100 available from Kajaani Oy Electronics, Kajaani, Finland or a similar fiber analyzer. According to the test procedure, a pulp sample is treated with a macerating liquid to ensure that no fiber bundles or shives are present. Each pulp sample is disintegrated in to hot water and diluted to an approximately 0.001% solution. Individual test samples are drawn in approximately 50 to 100 ml portions from the dilute solution when tested using the standard Kajaani fiber analysis test procedure. Population average fiber results are calculated by the analyzer and reported in millimeters.

Tissue Examples

To demonstrate the ability to use fractionated softwood fibers to make a soft tissue with less slough, several bathroom tissue prototypes were produced on a small-scale continuous pilot machine. It should be understood, however, that the invention is not limited to the manufacture of bathroom tissue.

The machine formed two separate tissue sheets and couched them together into a single sheet that was then pressed, dried and creped. This configuration allowed simulation of a layered tissue sheet with very high layer purity. Each former had its own stock system including stock chest, metering pump, fan pump and white water handling. This allowed each layer to have its own fiber blend and independent chemical treatment. The chemicals could be added to the chest to create a single batch at one concentration or metered into the stock line to allow periodic adjustment.

EXAMPLES 1–3

Tissue Samples Manufactured with Softwood Fibers: Control Specimens

Permanent wet strength additive (Kymene, available from Hercules, Inc) was provided in an amount equivalent to 4 lbs/ton (0.2%) to the dryer side stock chest containing eucalyptus fiber (Bahil Su, Inc.). The airside stock chest contained a northern softwood kraft fiber (LL-19, from Kimberly-Clark.). Permanent wet strength (Kymene, from Hercules, Inc) was also added in an amount equivalent to 4 lbs/ton (0.2%) to the LL-19 fiber. A dry strength agent (Parez from Cytec) was added to the softwood side stock pump to adjust tensile strength. Tissue samples with three levels of tensile strength were produced by adjusting the Parez addition level. In the converting stage, the tissue sheet was plied up with the hardwood on the outside. The tissue sheets contain 35% LL-19 softwood fibers and 65% eucalyptus fibers. The tensile strength, slough of the tissue sheets was tested. The softness properties of the tissue sheets were evaluated with panel testers as shown in Table 2 below.

EXAMPLES 4–6

Tissue Samples Manufactured With Fractionated Softwood Fibers

A repeat procedure as shown above for Examples 1–3 was employed, except that the short fraction of fiber was added to the dryer side (eucalyptus fiber) stock chest and long fraction of LL-19 was added to the air side (softwood fiber). The eucalyptus fiber stock chest will contain about 14% of short fraction of LL-19 fiber and about 86% of eucalyptus fibers. The tissue contains about 25% fiber from the air side stock chest (100% long fraction of LL-19 fiber) and about 75% fiber from the dryer side stock chest (mixture of 14% short fraction of long fraction of LL-19 fiber and 86% of eucalyptus fiber). Overall, the tissue sheet still contains 65% eucalyptus fiber as 35% LL-19 fiber as in Examples 1–3.

TABLE 2

| | | | Air Side | | | |
|---|---|---|---|---|---|---|
| Control | Dryer Side | | | Tensile Strength | Slough | Panel |
| Specimens | Euc | | LL-19 | g/3" width | (mg) | Stiffness |
| Example 1 | 65 | | 35 | 477 | 5.7 | 3.37 |
| Example 2 | 65 | | 35 | 716 | 6.56 | 3.94 |
| Example 3 | 65 | | 35 | 796 | 8.2 | 3.93 |
| Test Specimens with Fractionation | Euc | Short fraction LL-19 | Long Fraction LL-19 | | | |
| Example 4 | 65 | 10.5 | 24.5 | 540 | 4.95 | 3.62 |
| Example 5 | 65 | 10.5 | 24.5 | 641 | 6 | 3.75 |
| Example 6 | 65 | 10.5 | 24.5 | 773 | 4.57 | 4.14 |

The data indicates that, at a similar GMT, the tissue made with fractionated short softwood fiber in the eucalyptus layer (Example 6) has a significantly lower slough than the tissue made with no fractionated softwood fiber in the eucalyptus layer (Example 3), while both samples have a similar or comparable panel stiffness rating.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A method of making a tissue product, said method comprising:

fractionating a first furnish of softwood fibers into a long fiber fraction and a short fiber fraction;

diverting the short fiber fraction to a second furnish of hardwood fibers to form a third furnish;

forming a first layer using the long fiber fraction of the first furnish and a second layer using the third furnish; and incorporating the first layer and the second layer into a first ply, wherein the tissue product exhibits a level of slough that is less than the level of slough exhibited by an otherwise identical tissue product having a first layer formed from the first furnish of softwood fibers and a second layer formed from the second furnish of hardwood fibers, the first and second layers of the otherwise identical tissue product being formed without fractionating the first furnish of softwood fibers.

2. A method as defined in claim 1, wherein said first layer and said second layer define outer surfaces of the first ply.

3. A method as defined in claim 1, further comprising combining the first ply with a second ply.

4. A method as defined in claim 3, wherein the second ply is comprised of at least two layers.

5. A method as defined in claim 4, wherein one layer of the second ply is formed from the long fiber fraction of the first furnish and another layer is formed from the third furnish.

6. A method as defined in claim 5, wherein the layer of the second ply formed of the long fiber fraction of the first furnish is positioned adjacent to the first layer of the first ply.

7. A method as defined in claim 1, wherein the weight percentage of hardwood fibers in the tissue product is from about 60 and about 80 percent.

8. A method as defined in claim 1, wherein the weight percentage of hardwood fibers in the tissue product is from about 60 and about 70 percent.

9. A method as defined in claim 1, wherein the weight ratio of hardwood fibers to softwood fibers in the tissue product is about 2:1.

10. A method as defined in claim 1, wherein the hardwood fibers comprise eucalyptus fibers.

11. A tissue product formed according to the method of claim 1.

12. A method of making a multi-ply tissue product, said method comprising:

fractionating a first furnish of softwood fibers into a long fiber fraction and a short fiber fraction;

diverting the short fiber fraction to a second furnish of hardwood fibers to form a third furnish;

forming a first layer using the long fiber fraction of the first furnish and a second layer using the third furnish;

incorporating the first layer and the second layer into a first ply such that said first layer is adjacent to said second layer; and combining the first ply with a second ply, wherein the multi-ply tissue product exhibits a level of slough that is less than the level of slough exhibited by an otherwise identical multiply tissue product haying a first ply and a second ply, the first ply of the otherwise identical tissue product having a first layer formed from the first furnish of softwood fibers and a second layer formed from the second furnish of hardwood fibers, the first and second layers of the first ply of the otherwise identical tissue product being formed without fractionating the first furnish of softwood fibers.

13. A method as defined in claim 12, wherein the second ply is comprised of at least two layers.

14. A method as defined in claim 12, wherein one layer of the second ply is formed from the long fiber fraction of the first furnish and another layer is formed from the third furnish.

15. A method as defined in claim 12, wherein the layer of the second ply formed of the long fiber fraction of the first furnish is positioned adjacent to the first layer of the first ply.

16. A method as defined in claim 12, wherein the weight percentage of hardwood fibers in the tissue product is from about 50 and about 80 percent.

17. A method as defined in claim 12, wherein the weight percentage of hardwood fibers in the tissue product is from about 60 and about 70 percent.

18. A method as defined in claim 12, wherein the hardwood fibers comprise eucalyptus fibers.

19. A tissue product formed according to the method of claim 12.

20. A method of making a multi-ply tissue product, said method comprising:

fractionating a first furnish of softwood fibers into a long fiber fraction and a short fiber fraction;

diverting the short fiber fraction to a second furnish of hardwood fibers to form a third furnish;

forming a first layer using the tong fiber fraction of the first furnish and a second layer using the third furnish;

incorporating the first layer and the second layer into a first ply such that said first layer is adjacent to said second layer; and combining the first ply with a second ply, said second ply being comprised of at least two layers in which one layer of the second ply is formed from the long fiber fraction of the first furnish and another layer is formed from the third furnish, wherein the layer of the second ply formed from the long fiber fraction of the first furnish is positioned adjacent to the first layer of the first ply, wherein the multi-ply tissue product exhibits a level of slough that is less than the level of slough exhibited by an otherwise identical multi-ply tissue product having a first ply and a second ply, the first and second plies of the otherwise identical tissue product each having a first layer formed from the first furnish of softwood fibers and a second layer formed from the second furnish of hardwood fibers, the first and second layers of the first and second plies of the otherwise identical tissue product being formed without fractionating the first furnish of softwood fibers.

21. A tissue product formed according to the method of claim 20.

* * * * *